United States Patent [19]

Chamberlain

[11] Patent Number: 4,687,412

[45] Date of Patent: Aug. 18, 1987

[54] IMPELLER SHROUD

[75] Inventor: Stephen S. Chamberlain, Dollard des Ormeaux, Canada

[73] Assignee: Pratt & Whitney Canada Inc., Longueuil, Canada

[21] Appl. No.: 751,572

[22] Filed: Jul. 3, 1985

[51] Int. Cl.[4] ..... F04D 29/14

[52] U.S. Cl. ..... 415/134; 415/174; 415/DIG. 1

[58] Field of Search ..... 415/134–139, 415/144, 145, 170 R, 170 A, 174, 219 C, 206, 211, DIG. 1

[56] References Cited

U.S. PATENT DOCUMENTS

| | | | |
|---|---|---|---|
| 3,130,678 | 4/1964 | Chenault | 415/206 X |
| 3,493,169 | 2/1970 | Abild et al. | 415/144 |
| 3,656,862 | 4/1972 | Rahaim et al. | 415/174 X |
| 4,248,566 | 2/1981 | Chapman et al. | 415/DIG. 1 X |
| 4,264,271 | 4/1981 | Libertini | 415/134 X |
| 4,302,149 | 11/1981 | Smale | 415/134 |
| 4,455,121 | 6/1984 | Jen | 415/211 X |
| 4,479,755 | 10/1984 | Skoe | 415/DIG. 1 X |

FOREIGN PATENT DOCUMENTS

| | | | |
|---|---|---|---|
| 4750685 | 3/1970 | Japan | 415/174 |

*Primary Examiner*—Robert E. Garrett
*Assistant Examiner*—Joseph M. Pitko
*Attorney, Agent, or Firm*—Schwartz, Jeffery, Schwaab, Mack, Blumenthal & Evans

[57] ABSTRACT

An impeller shroud is mounted in a cantilever manner to a stator assembly in a compressor for a gas turbine engine, wherein the impeller has a radial component, the impeller shroud being adapted for deflection around its outer portion in correspondence with deflection which may occur in the outer portion of the impeller. The stator assembly includes a shroud surrounding the compressor gas path and is directly fixed to the casing of the engine and has a common datum with the rotor portion of the compressor through a thrust bearing.

6 Claims, 2 Drawing Figures

IMPELLER SHROUD

BACKGROUND OF THE INVENTION

1. Field of the Invention

The present invention relates to gas turbine engines, and more particularly to a compressor impeller shroud construction for a gas turbine engine.

2. Description of the Prior Art

The compressor impeller in a Pratt & Whitney PT6 engine is the last compressor stage, being downstream of a series of alternating axially arranged compressor rotors and stators. It has an axial component and a radial component with the outlet portion of the impeller discharging the air so compressed radially into a tangential annular diffuser. The impeller hub is mounted to the compressor shaft while the impeller blades are unshrouded and are integral at their respective bases with the hub. The hub which supports the blades has a portion which is almost cylindrical and is massive at its inlet end and spreads out to a much thinner radial plate at its outlet end.

A static impeller shroud is conventionally mounted to the case of the engine in the compressor section by means of a support ring fixed to the case.

In the PT6 engine, struts extend across the gas path at the air intake supporting the outer case against the inner case which supports a thrust bearing. The thrust bearing is the support for the shaft and thus all the rotating parts of the compressor including the impeller. In other words, the only common datum for the tips of the impeller blades and the impeller shroud, which must be kept at close tolerances thereto, is the thrust bearing. Thus, thermal expansion grows from the thrust bearing for both the impeller blade tips and the impeller shroud. However, the path of expansion growth for the impeller shroud is much greater than for the impeller tips. The expansion growth for the impeller is directly through the rotor assembly to the thrust bearing, while the expansion growth for the impeller shroud is through the outer case.

Furthermore, it has been found that the outer periphery of the impeller can be distorted as a result of centrifugal forces due to its high rotational speed. Since the impeller shroud is fixed to the diffuser, it will remain static while the tips of the impeller blades will tend to reduce the clearance between the shroud and the blade tips. Furthermore, in a typical PT6 engine, the diffuser is fixed to a diaphragm structure which extends from the casing through the diffuser to a bearing on the gas generator side of the engine. During surge conditions, the pressure differential across this diaphragm structure causes axial deflection of the impeller shroud relative to the impeller blades in a direction opposite from the mechanical deflection of the impeller blades due to centrifugal forces.

SUMMARY OF THE INVENTION

It is an aim of the present invention to provide an improved impeller shroud construction, and in particular, the support of such impeller shroud.

It is a further aim of the present invention to provide an impeller shroud which will deflect in the same manner as the impeller outlet portion so as to maintain a relatively constant clearance.

It is a further aim of the present invention to provide a more direct thermal expansion growth path and particularly one that is of similar distance from its common datum with the impeller such that the thermal expansion or contraction of the impeller shroud will be similar to that of the impeller so as to maintain relatively constant blade tip clearance.

A construction in accordance with the present invention comprises a compressor for a gas turbine engine comprising an engine housing a rotor assembly, including an impeller. The impeller has an inlet portion having an axial component and an outlet portion having a radial component. The impeller includes a hub having a flared cantilever radial configuration and a plurality of blades thereon, and the blades have unshrouded tips. The rotor assembly is mounted to the engine housing by bearing means. A stator assembly mounted to the housing includes a shroud surrounding and concentric with the rotor assembly. The shroud includes an impeller shroud member. The impeller shroud has a flared shape with an inlet portion fixed to the shroud and the outlet portion being unsupported. The impeller shroud surrounds, with minimum clearance, the blade tips of the impeller, whereby any deflection of the impeller shroud will occur at the outlet portion thereof in correspondence with any deflection of the outlet portion of the impeller.

Thus, the thermal expansion growth distance of the impeller shroud is substantially similar to the expansion growth distance of the impeller from the bearing means. The fact that the impeller shroud is fixedly connected to the remainder of the shroud at its inlet portion, that is, at the area of smallest diameter of the impeller shroud, the remainder of the impeller shroud is thus cantilevered, and any deflection caused by pressure differences acting on the impeller and impeller shroud will cause the cantilevered outlet portions thereof to deflect in unison, thereby maintaining minimum clearance between the shroud and the blade tips.

In a more specific embodiment of the present invention, the outlet portion of the impeller shroud is provided with sealing means adapted to sealingly engage a partition member. The sealing means may be in the form of sealing rings mounted on the periphery of the outlet portion of the impeller shroud adapted to slidingly engage the partition member.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
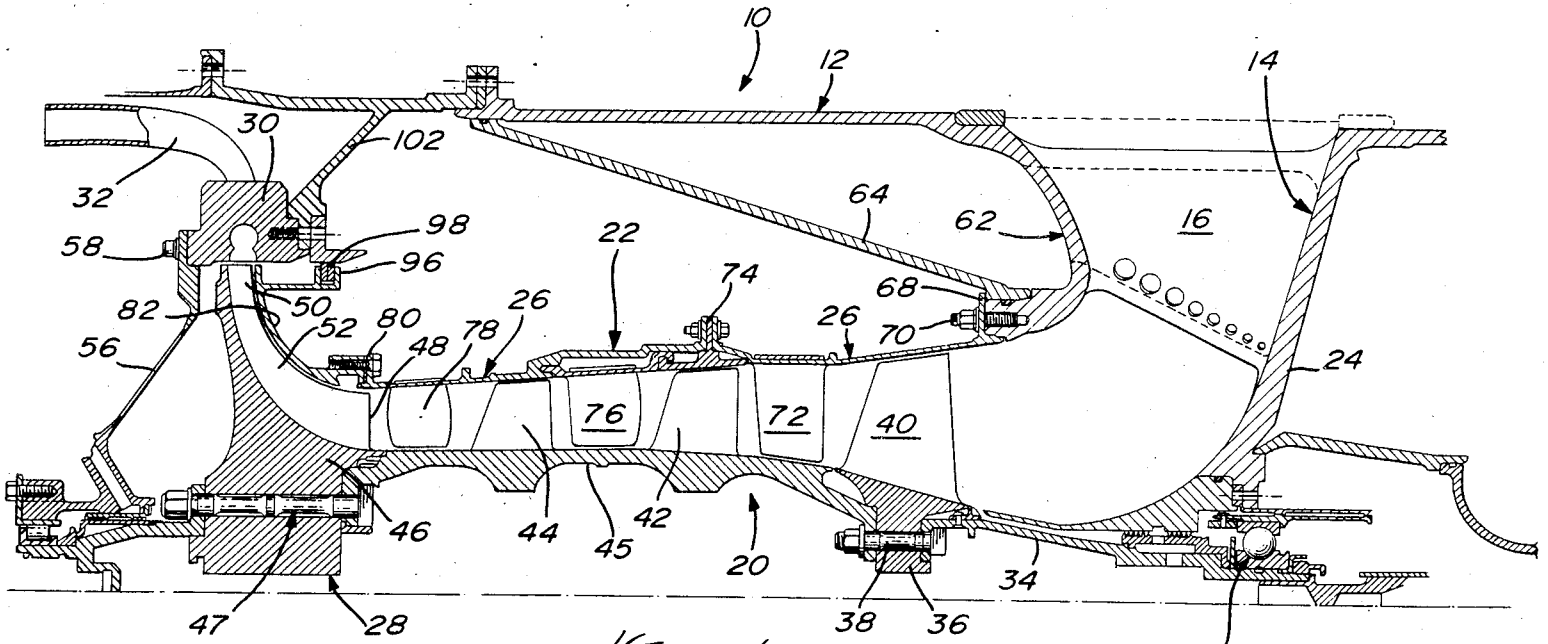
FIG. 1 is an axial cross-section of the compressor section of a gas turbine engine incorporating the present invention.

Referring now to the drawings, there is shown in a compressor section 10 of a gas turbine engine an outer case 12 which defines an annular inlet 14. The annular case 12 surrounds the compressor section 10, and the struts 16 are spaced apart peripherally across the annular inlet 14. A thrust bearing 18 surrounds the shaft and mounts the rotor assembly 20. The thrust bearing 18 is mounted within the inner case 24 which is connected directly to the struts 16 and is thus supported by the outer case 12. The outer case 12 also mounts a stator assembly 22 which comprises shroud members 26 for the rotor assembly which will be described further.

Annular inlet 14 permits an air flow to enter the compressor section 10 of the engine, and the path of the air flow is axial, past the rotor and stator assemblies to finally reach the impeller 28 which turns the air flow from an axial path to a radial path through the diffuser 30 and then axially through the pipes 32 into the gas generator section.

The rotor assembly includes a somewhat cylindrical rotor support member 34 mounting rotor blade hubs 36 by means of the bolts 38. Rotor blades 40 represent the first stage of rotors in the compressor section. A further cylindrical rotor support member 45 is bolted to the hub 36 by means of bolts 38 and to the hub 46 of the impeller 28 by means of the bolts 47. The cylindrical rotor support member 45 mounts the second and third stages of rotor blades, identified 42 and 44. These blades are unshrouded and are adapted to rotate with close tolerances between the rotor blade tips and the static shroud 26 forming part of the stator assembly 22.

The impeller 28 includes a hub 46 mounted on the shaft (not shown) and mounts the radially extending impeller blades 52 having blade tips 54. The impeller blades have an axial component in the inlet portion 48 of the impeller and are turned such that the blades have a radial component at the outlet 50 of the impeller. The diffuser 30 is mounted to the support ring 102 of the case 12 and supports, by means of the diaphragm 56, the roller bearing which supports the rotor assembly by means of a support shaft. The impeller 28, on the other hand, is in fact cantilevered in that the outlet section 50 of the impeller is somewhat flared and is, of course, unsupported at its extremities or, that is, in the outlet segment.

The stator assembly includes the intake outer case wall 62 which is mounted directly to the struts 16 and is integral with outer case wall 12. The shroud 26 is provided with a flange 68 and is adapted to be bolted to the intake outer case wall 62 by means of bolts 70. Shroud 26 acts as a circumferential shroud for the rotor blades 40 of the first stage and mounts the stator vanes 72 of the first stator stage. The shroud 26 is in ring sections and is bolted at flanges and bolt assembly 74 and also mounts a shroud ring for the second rotor stage blades 42. Shroud 26 also mounts the stator blades 76 of the second stage, and finally the stator vanes 78 of the third stage.

Figure 2:
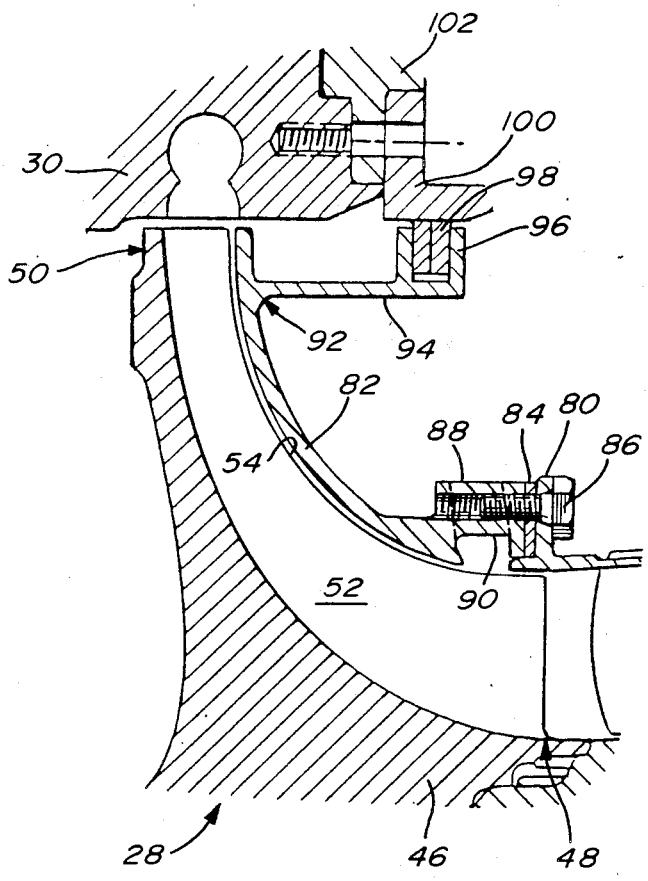
FIG. 2 is an enlarged fragmentary axial cross-section of a detail shown in FIG. 1.

The stator assembly shroud 26 has a configuration of an axial cylinder connected by bolts 70 to the inlet outer case wall 62 at one end. A flared impeller shroud 82 is mounted to the flange 80 on the shroud 26 by means of bolts 86. As shown in FIG. 2, shims 84 may be provided between the flange 80 and the bosses 88 provided on the impeller shroud 82 for the purpose of being bolted by means of the bolt 86. The provision of the shims 84 allows for axial displacement or adjustment of the impeller shroud relative to the impeller. Shims can be removed without taking apart the assembly. Between each boss 88 are slots, which provide for bleeding air from the compressor.

The impeller shroud 82 is flared and follows a similar curvature to that of the blade tips 54 of the impeller 28. The impeller shroud 82 has an outlet portion 92 near the outlet portion 50 of the impeller 28. Mounted to the impeller shroud at the outlet portion 92 is an axially extending cylindrical flange member 94 provided with a peripheral channel 96 in which are located a pair of sealing rings 98. The sealing rings 98 are adapted to be in contact with the adaptor ring 100 provided on the support ring 102 mounted to the casing. There is no fixed connection between flange 94 and the sealing rings 98 with the adaptor ring 100. Rather, the sealing rings 98 allow relative movement of the impeller shroud outlet portion 92 relative to the adaptor ring 98 while maintaining a sealing contact therewith.

It can be seen from the above description and the drawings that the thermal expansion growth path of the stator assembly mounting the impeller shroud 82 is of a similar length through the shroud 26, the case 62, strut 16, and inner case 24 to the thrust bearing 18, as the thermal expansion growth path of the impeller 28 through the rotor assembly 20, the hub 36, rotor support 34, and thus to the thrust bearing 18. The rotor support member 45 and the shroud 26 are the contact surfaces of the gas path of the compressor, and thus the thermal characteristics of both surfaces will be the same. Therefore, the expansion growth due to thermal considerations of the impeller shroud 82 will be similar to that of the impeller 28.

In operation, there may be considerable pressure differences arising between the gas generator section and the compressor section. For instance, under surge conditions, even though the impeller might deflect axially in the direction of the thrust bearing due to centrifugal forces, and the diffuser might be forced to move axially slightly in the opposite direction because of the diaphragm support structure, the impeller shroud, which is cantilevered from its smallest diameter and which mounts the sealing rings 98 against the diffuser structure, is allowed to move relative to the shroud and deflect in the same direction as the slight deflection of the impeller towards the thrust bearing.

This, of course, is in comparison with the conventional manner of mounting the impeller shroud from the outer casing which would not allow for such deflection in the outlet portion of the impeller shroud.

I claim:

1. In a compressor for a gas turbine engine, an engine housing, a rotor assembly including an impeller, the impeller having an inlet portion with an axial component and an outlet portion with a radial component, the impeller including a hub having a flared cantilever radial configuration and a plurality of unshrouded blade tips, the rotor assembly being mounted to the engine housing by bearing means, a stator assembly including a shroud surrounding and concentric with the rotor assembly, the shroud including an impeller shroud member, the impeller shroud having a flared shape with an inlet portion fixed to the shroud and an outlet portion being unsupported, means mounting the stator assembly shroud to the engine housing only in the area of said bearing downstream of the compressor relative to the impeller, such that the shroud including the impeller shroud are supported at the area of said bearing in a cantilever manner and the thermal expansion growth distance of the impeller shroud is the same as the expansion growth distance of the impeller from the bearing, the impeller shroud surrounding the blade tips of the impeller with minimum clearance and whereby any deflection of the impeller shroud will occur at the outlet portion thereof in correspondence with any deflection of the outlet portion of the impeller.

2. In a compressor as defined in claim 1, wherein the engine housing includes an outer case surrounding the compressor, the impeller shroud mounts sealing rings adapted to sealingly engage the outer case while allowing relative movement of the outlet portion of the impeller shroud to the outer case.

3. In a compressor as defined in claim 2, wherein the sealing rings are offset of the radial component of the impeller shroud.

4. In a compressor as defined in claim 3, wherein a cylindrical flange extends from the impeller shroud near the outlet end of the impeller shroud and mounts a channel which is provided at least one sealing ring extending peripherally of the impeller shroud.

5. In a compressor as defined in claim 1, wherein the stator assembly includes a flange extending peripherally thereof and adapted to mount the end of the impeller shroud having the smallest diameter and a series of spaced-apart bosses being provided on the impeller shroud for bolting to the flange and shim means are provided for adjusting the relative position of the impeller shroud to the shroud.

6. In a compressor as defined in claim 5, wherein between each boss there is provided a slot for allowing bleeding of the air in the compressor.

* * * * *